US005640822A

United States Patent [19]

Haswell

[11] Patent Number: 5,640,822

[45] Date of Patent: Jun. 24, 1997

[54] TRUSS ANCHOR

[75] Inventor: Jack Haswell, Tifton, Ga.

[73] Assignee: Mastercraft Engineering, Tifton, Ga.

[21] Appl. No.: 538,405

[22] Filed: Oct. 2, 1995

[51] Int. Cl.[6] ..... E04B 1/38

[52] U.S. Cl. ..... 52/712; 52/702; 52/92.2

[58] Field of Search ..... 52/712, 702, 714, 52/93.1, 93.2, 92.2

[56] References Cited

U.S. PATENT DOCUMENTS

| | | | |
|---|---|---|---|
| 3,889,440 | 6/1975 | Sutter | 52/714 |
| 3,889,441 | 6/1975 | Fortine | 52/714 X |
| 4,047,352 | 9/1977 | Sweet | 52/712 X |
| 4,665,672 | 5/1987 | Commins et al. | 52/714 X |
| 5,448,871 | 9/1995 | Newman et al. | 52/712 |

*Primary Examiner*—Wynn E. Wood
*Assistant Examiner*—Timothy B. Kang
*Attorney, Agent, or Firm*—Janet E. Witt; James M. Jordan, III

[57] ABSTRACT

A truss anchor for securely attaching a truss member to an underlying support wall includes at least one unitary band having a cap portion for partially surrounding the truss member, and a wing portion extending downwardly from the cap portion and in angular relation to the cap portion as defined by a longitudinally extending bend in the unitary band. An attachment flange extends downwardly from the wing portion, and in the same vertical plane occupied by the wing portion, for attachment of the anchor to a stud of the underlying support wall. The attachment flange is attached individually or is stacked with a second, adjacent attachment flange for attachment to the stud. Suitable fasteners are used to attach the flanges to the stud.

13 Claims, 3 Drawing Sheets

TRUSS ANCHOR

TECHNICAL FIELD

The invention relates to an apparatus for anchoring one structural support member of a building to another structural support member and more particularly to a truss anchor formed from a unitary piece of material having a centralized attachment point and a minimum number of strength reducing deformations in the unitary piece of material for secure anchoring of a roof truss member to an underlying support stud.

BACKGROUND OF THE INVENTION

In the construction of buildings having pitched roofs, truss members are secured to the underlying support structure of the building through the use of a truss anchorage device. Existing truss anchorage devices are fabricated as a unitary band of material, usually a semi-pliable metal, with bends at various locations to form a cap portion, two opposed wing portions, and two opposed attachment flanges.

The cap portion is located in the approximate middle of the unitary band and extends over the distal end of the top chord of the truss member. The two opposed wing portions extend horizontally downwardly from the cap portion at ninety degree (90°) angles to the cap portion on opposite sides of the truss member and are bent vertically at a ninety degree (90°) angle relative to the planar surface of the cap to extend at a spaced apart interval within the same plane and adjacent to the surface of an exterior edge of an underlying horizontally extending wall support frame member, thereby functioning as a retaining surface relative to positioning of the truss in relation to the exterior surface of the wall support frame. Extending downwardly from each wing portion is an attachment flange, bent at a ninety degree (90°) angle relative to the planar surface of the wing portion, to allow attachment of the truss anchorage to opposed surfaces of the underlying vertically extending support stud. Thus, the unitary band of material in existing truss anchorage devices is subjected to at least six areas of deformation to create the ninety degree (90°) angles to form the cap portion, the two wing portions, and the two attachment flanges, thus creating six potential areas of weakness or possible failure of the truss anchorage device.

In other existing truss anchorage devices, two separate unitary band of material are used, deleting the cap portion, and thereby deleting two of the ninety degree angles (90°) of deformation in the device. Although deletion of the cap portion reduces the number of deformations in the band of material forming the anchorage device, it also reduces the degree of stability realized through use of a single unitary band of material including the cap portion extending over the distal end of the top chord of the truss member.

In addition to weakness created by the multiple bends or deformations in the surface of the unitary bands of material, the same number of fasteners, such as nails or screws, must be used in each of the opposed attachment flanges for anchoring the truss anchorage device to the opposed sides of the underlying support stud. Thus, the total number of fasteners used is split in half for the two opposed attachment locations, thereby limiting the strength at any one attachment location to half of the total strength provided by the fasteners should they be placed in a single location.

SUMMARY OF THE INVENTION

The preferred embodiment truss anchorage device of the present invention overcomes the foregoing problems by eliminating two of the ninety degree (90°) angle deformations, without deleting the cap portion, and creating a single attachment surface for both of the attachment flanges, thereby reducing the potential weak or failure areas in the unitary band of material and concentrating the total number of fasteners, such as nails or screws, necessary for attachment of the truss anchorage device to the underlying support stud to a single location on one surface of the stud to strengthen the attachment to the stud. Furthermore, the positioning of the single attachment location of the anchorage device of the present invention allows repairs to be made to a damaged roof truss, in conformance with new building codes and federal guidlines, without having to tear out and replace insulation or structural bracing between adjacent wall studs. This advantage is especially beneficial in areas susceptible to hurricane or tornado damage.

In the preferred embodiment truss anchorage device, the ninety degree (90°) angle bends between the planar surfaces of the wing portions and the attachment flanges is omitted, deleting two potential failure sites present at the crucial attachment point in existing anchorage devices. Deletion of the potential failure sites creates the stronger truss anchorage device of the present invention.

When the ninety degree (90°) angle bends between the planar surfaces of the wing portions and the attachment flanges is omitted, the attachment flanges extend adjacent one another instead of opposite one another as in existing truss anchorage devices, and are attached to a single outwardly facing surface of the underlying support stud. When attaching the flanges to the support stud, the flanges may be positioned adjacent one another or one on top of the other with openings in the flanges, for receiving the fasteners therein, in positional alignment. Inclusion of adjacent attachment flanges concentrates in one location the total number of fasteners needed to attach the anchorage device to the underlying support stud, thereby strengthening the attachment point.

Other embodiments of the invention may include the use of two separate bands of material, deleting the cap portion, but also deleting the two ninety degree (90°) angle bends between the planar surfaces of the wing portions and the attachment flanges, thereby reducing the number of potential failure sites of existing two part truss anchorage devices. Similarly, other embodiments of the invention may include the use of different materials of construction, other than metal.

Further advantages of the truss anchorage device of the present invention will become apparent from the following Detailed Description and accompanying Drawings.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
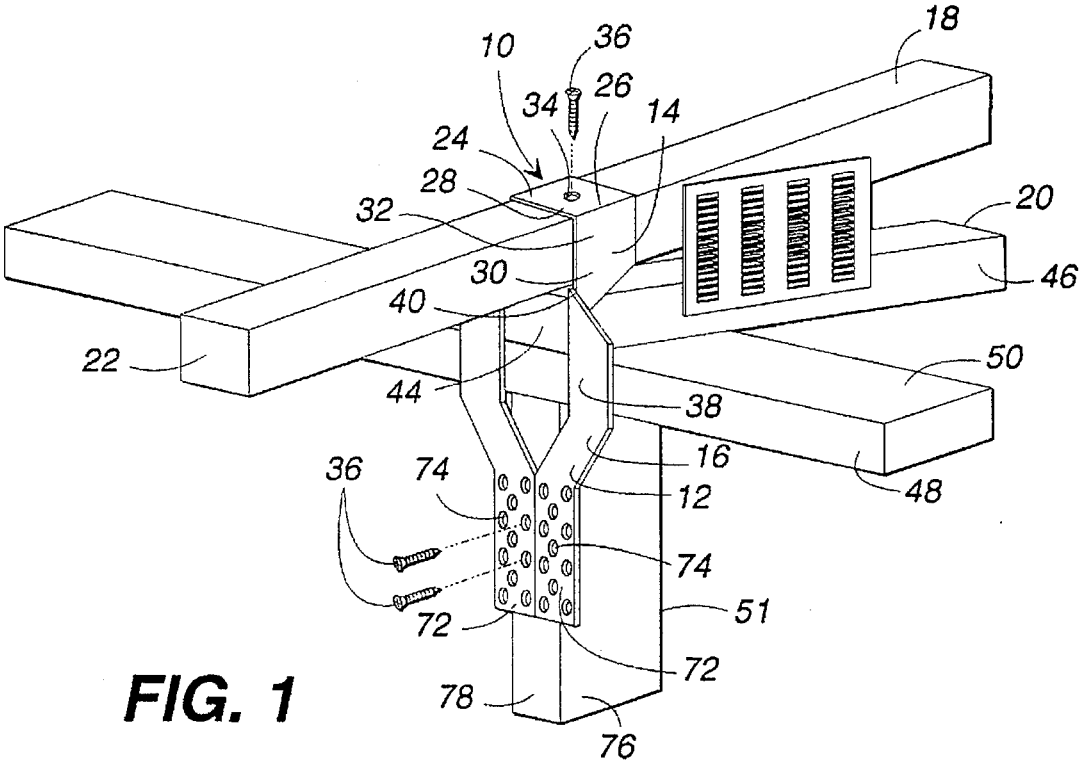
FIG. 1 is a perspective view of a truss anchorage device incorporating a first embodiment of the present invention.

Referring now to the Drawings, and in particular to FIG. 1, there is shown a perspective view of a truss anchor 10 incorporating the preferred embodiment of the present invention. The truss anchor 10 is fabricated from a unitary band of material 12 having a first planar surface 14 and a second planar surface 16.

The band 12 is positioned to extend transversely over the top chord 18 of a truss member 20 near the distal end 22 of the top chord 18, as used in interior zones of a building. Following the shape of the top chord 18, the band 12 is bent transversely at a ninety degree (90°) or right angle at a first location 24 and at a second location 26 to form the top 28 and two sides 30 of a first section or cap portion 32 of the truss anchor 10. At least one aperture 34 extends through the top 28 of the cap portion 32 for receiving a fastener 36, such as a nail or screw, therethrough for fixedly attaching the cap portion 32 of the truss anchor 10 to the top chord 18 of the truss member 20.

To form two second sections or wing portions 38 of the truss anchor 10, the band 12 is bent at ninety degree (90°) angles longitudinally at third and forth locations 40 and 42 (not shown), respectively. The first planar surface 14 of the band 12 in the second sections or wing portions 38 extends adjacent to and in contact with the distal end 44 of the bottom chord 46 of the truss member 20 and perpendicular to and in contact with the outwardly facing surface 48 of a horizontally extending wall frame member 50. The wing portions 38 extend at a spaced apart interval from one another within the same vertical plane to retain the truss member 20 in position relative to the outward surface of the wall frame 51.

Figure 6:
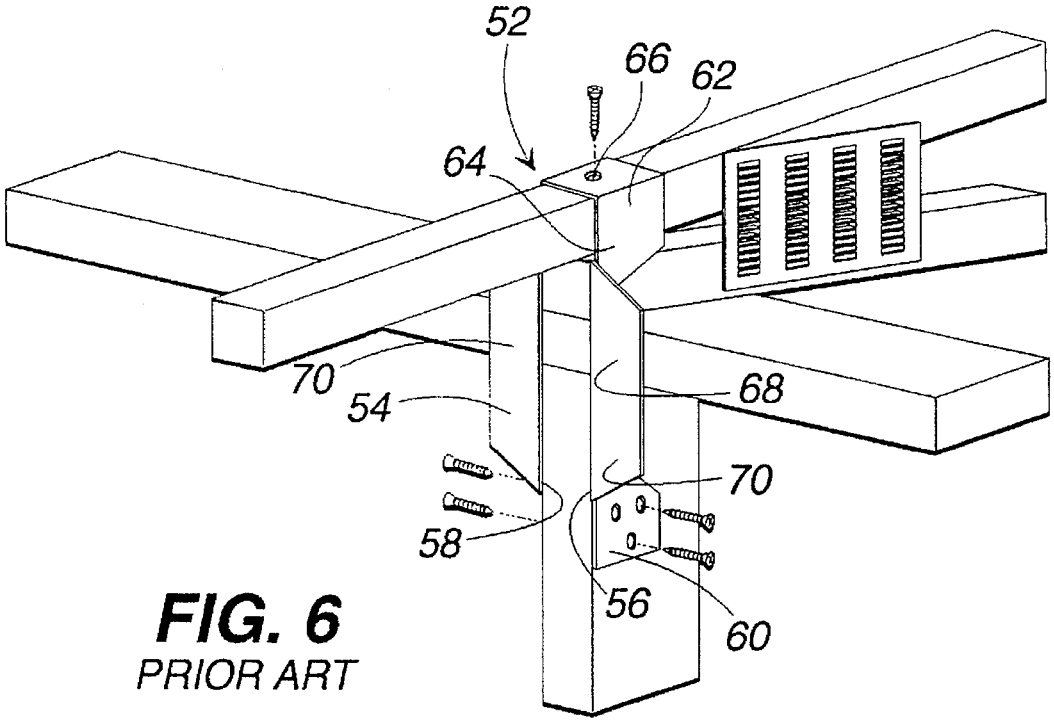
FIG. 6 PRIOR ART
FIG. 6 is a perspective view of a second embodiment of a prior art truss anchorage device.

Referring now to FIGS. 1 and 6, in prior art truss anchorage devices 52, as shown in FIG. 6, the band 54 is bent in fitch and sixth locations 56 and 58, respectively to form attachment flanges 60 wherein the first planar surface 62 of the band 54 in the region of the flanges 60 extends in the same vertical plane as the first planar surface 62 of the band 54 in the region of the sides 64 of the cap portion 66 and perpendicular to the vertical plane in which the planar surfaces 62 and 68 of the wing portions 70 extend. The truss anchor 10, as shown in FIG. 1, does not contain fifth and sixth bends corresponding to the bends at the fifth and sixth location 56 and 58 along the band 54 of the prior art truss anchorage device 52. Two third sections or attachment flanges 72 of the truss anchor 10 extend downwardly from the wings 38, with the second planar surface 16 of the band 12 extending in the same vertical plane in the region of the wings 38 and in the region of the attachment flanges 72, avoiding the introduction of weakness or possible failure by deleting the fifth and sixth bends 56 and 58, respectively, of prior art truss anchorage devices 52.

Figure 2:
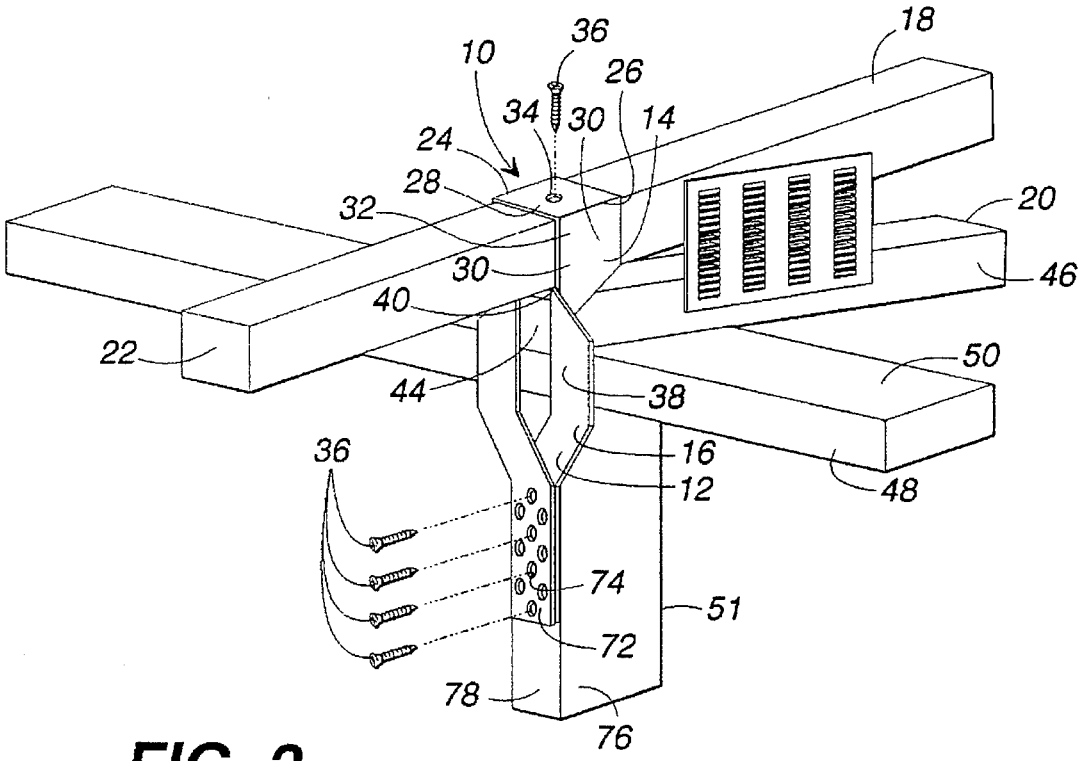
FIG. 2 is a perspective view illustrating the overlap of the attachment flanges of the truss anchorage device of FIG. 1.

Referring now to FIGS. 1 and 2, the attachment flanges 72 have at least four apertures 74 therein for receiving fasteners 36 therethrough for attachment of the truss anchor 10 to an underlying, vertically extending support stud 76. Because the attachment flanges 72 extend adjacent one another and in the same vertical plane, they are attached to the support stud 76 on a single, normally outwardly extending, surface 78 of the stud 76, thereby concentrating in one location the total number of fasteners 36 required to secure the truss anchor 10 to the stud 76. As shown in FIG. 2, the attachment flanges 72 may be positioned one on top of the other, with the apertures 74 positionally aligned such that all of the necessary fasteners 36 extend through the apertures 74 in both of the two attachment flanges 72 to secure the truss anchor 10 to the underlying stud 76.

Figure 3:
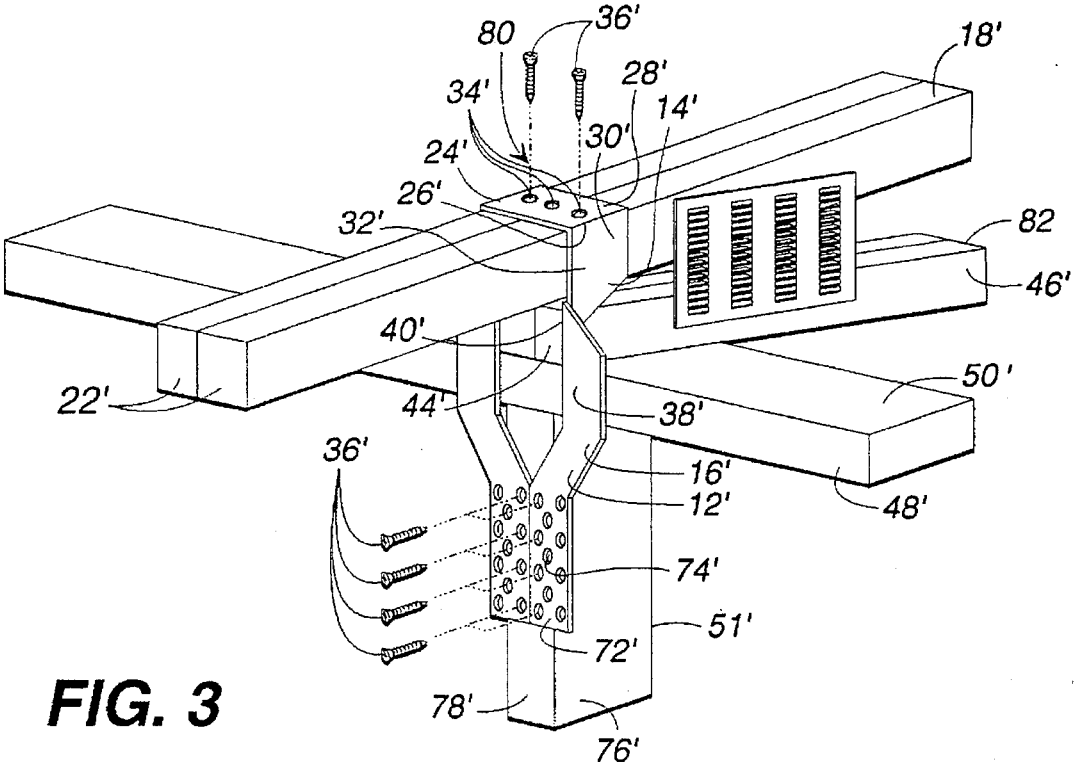
FIG. 3 is a perspective view of a truss anchorage device incorporating a second embodiment of the present invention.

Referring now to FIG. 3, there is shown a truss anchor 80 incorporating a second embodiment of the present invention. Many of the elements of the truss anchor 80 are similar to those of the truss anchor 10 and will be given the same reference numerals with the elements of the truss anchor 80 being differentiated by a prime (') designation. The top 28' of the cap portion 32' of the truss anchor 80 extends transversely over the top chord 18' of a double truss member 82 near the distal end 22' of the top chord 18', as used at the end zones or at roof openings of a building. At least two apertures 34' extend through the top 28' of the cap portion 32' for receiving fasteners 36' therethrough for attachment of the truss anchor 80 to the top chord 18' of the double truss member 82.

Referring still to FIG. 3, each attachment flange 72' has at least four apertures 74' for receiving fasteners 36' therethrough for fixed attachment of the truss anchor 80 to the outwardly extending surface 78' of the underlying stud 76'. As with the truss anchor 10 shown in FIG. 2, the attachment flanges 72' of the truss anchor 80 may be attached to the surface 78' of the stud 76' adjacent one another, or one on top of the other with the apertures 74' in positional alignment for receiving all of the necessary fasteners 36' through the apertures 74' of both of the flanges 72', thereby increasing the strength of the attachment of the truss anchor 80 to the underlying stud 76'.

Figure 4:
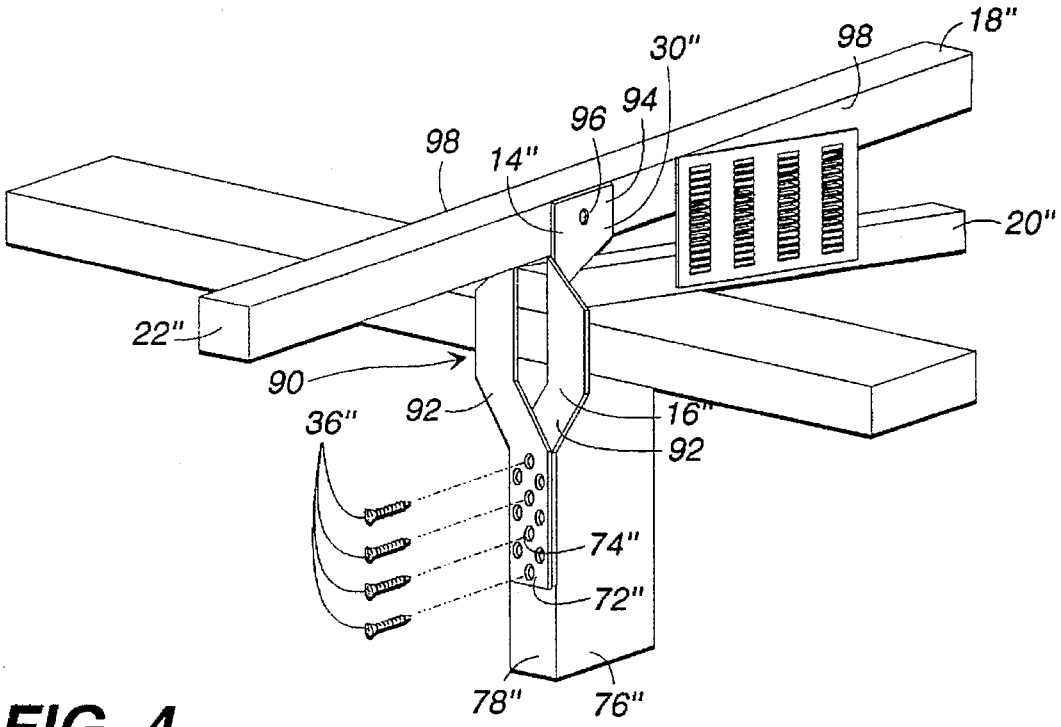
FIG. 4 is a perspective view of a truss anchorage device incorporating a third embodiment of the present invention.

Referring now to FIG. 4, there is shown a truss anchor 90 incorporating a third embodiment of the present invention. Many of the elements of the truss anchor 80 are similar to those of the truss anchor 10 and will be given the same reference numerals with the elements of the truss anchor 80 being differentiated by a double prime(") designation.

Referring still to FIG. 4, the truss anchor 90 is fabricated from two separate, but individually unitary bands 92. Unlike the truss anchors 10 and 80, the cap portion 94 of the truss anchor 90 has no top 28 nor 28'. Instead, at least one aperture 96 extends through each side 30" of the cap portion 94 for receiving a fastener 36" therethrough for attachment of the truss anchor 90 to opposed sides 98 of the top chord 18" of a truss member 20" near the distal end 22" of the top chord 18".

Figure 5:
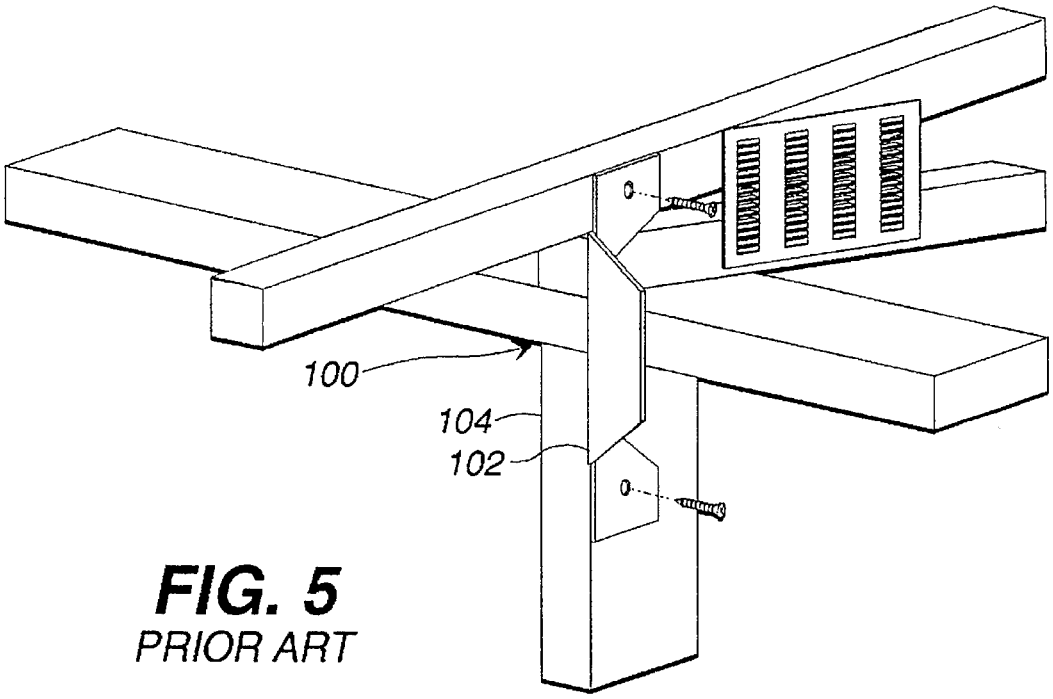
FIG. 5 PRIOR ART
FIG. 5 is a perspective view of a prior art truss anchorage device.

Referring still to FIG. 4, as with the truss anchor 10 shown in FIG. 2, the attachment flanges 72" of the truss anchor 90 may be attached to the surface 78" of the stud 76" adjacent one another, or one on top of the other with the apertures 74" in positional alignment for receiving all of the necessary fasteners 36" through the apertures 74" of both of the flanges 72", thereby increasing the strength of the attachment of the truss anchor 90 to the underlying stud 76". Unlike the prior art truss anchorage device 100 shown in FIG. 5, the truss anchor 90 avoids the introduction of weakness or possible failure near the attachment point of the attachment flanges 72" to the underlying stud 76' and concentrates the strength of all the fasteners 36" in one location by deleting the second and third bends 102 and 104, respectively, of the prior art truss anchorage device 100.

While it is understood that in the preferred embodiment of the truss anchors 10, 80 and 90 are formed to the desired shape shown and described from a single thin sheet of semi-pliable or workable metal or composite material, any of a number of other materials readily available in commerce having similar workability and sufficient strength qualities may be utilized in constructing the truss anchors 10, 80, and 90. It is further understood that the degree of the angle created by bending the bands 12, 12' and 92 may be any appropriate degree of angularity necessary to conform to the relevant contours of the subject truss member or support member. Although the invention is described as using nails or screws for fasteners, it is understood that other readily available fasteners such staples, rivets, or suitable adhesives may be used without departing from the spirit of the invention.

Although preferred embodiments of the invention have been illustrated in the accompanying Drawings and described in the foregoing Detailed Description, it will be understood that the invention is not limited to the embodiments disclosed but is capable of numerous rearrangements and modifications of parts and elements without departing from the spirit of the invention.

I claim:

1. Apparatus for securing a first structural member to at least a second structural member, comprising:

at least one unitary band of material;

a first section formed in the band for partially surrounding the first structural member;

at least one second section formed in the band adjacent the first section by creating a longitudinal bend in the band to define the first and second sections wherein said second section has a linear longitudinal central axis and said second section is capable of being installed such that said second section is coplanar with an outer face of the second structural member; and at least one third section extending from and coplanar with the second section for attachment of the third section to the second structural member, with a part of said third section having a longitudinal central axis which is not collinear with the linear longitudinal central axis of the second section.

2. The apparatus of claim 1 wherein the first section further comprises:

a cap portion having a top portion and two opposed side portions created by forming two spaced apart transversely extending bends in the first section of the band.

3. The apparatus of claim 1 wherein the band further comprises a semi-pliable metal.

4. The apparatus of claim 1 further comprising means for securely fastening the third section of the band to the second structural member.

5. The apparatus of claim 4 wherein the means for fastening further comprises apertures extending through the third section for receiving fasteners therethrough for attachment to the second structural member.

6. The apparatus of claim 1 wherein two adjacent third sections are positionable for attachment to the second structural member with one of the third sections positioned in stacked alignment between the other third section and the second structural member.

7. The apparatus of claim 1 further comprising two unitary bands.

8. An anchor device for securely connecting a first structural member to an underlying structural member, comprising:

a thin band of semi-rigid material;

a cap portion for partially surrounding the first structural member and formed in the approximate center of the band by two spaced apart, transversely extending deformations in the band;

first and second wing portions formed by longitudinally extending deformations in the band to define an angular relation between each of the first and second wing portions and the adjacent cap portion, wherein each of said first and second wing portions has a linear longitudinal central axis, and is capable of being installed such that said wing portion is coplanar with an outer face of the underlying structural member; and first and second attachment flanges, for attaching the anchor device to the underlying structural member which extend from and are coplanar with, respectively, the first and second wing portions, with a part of each of said first and second attachment flanges having a linear longitudinal central axis which is not collinear with the linear longitudinal central axis of the wing portion from which said attachment flange extends.

9. The device of claim 8 further comprising apertures extending through the attachment flanges for receiving fasteners therethrough for attachment to the underlying structural member.

10. The device of claim 8 wherein the two attachment flanges are positionable for attachment to the underlying structural member with one of the flanges positioned in stacked alignment between the second flange and the underlying structural member.

11. The device of claim 8 further comprising means for securely fastening the cap portion of the band to the first structural member.

12. A truss anchor for securely fastening a truss member to a support wall, comprising:

a thin band of semi-rigid material;

a cap portion for partially surrounding the first structural member and formed in the approximate center of the band by two spaced apart, transversely extending deformations in the band;

means for fixedly attaching the cap portion to the truss member;

two wing portions formed by longitudinally extending deformations in the band to define an angular relation between the wing portions and the adjacent cap portion, wherein said wing portions each have a linear longitudinal central axis, and are capable of being installed such that said wing portions are coplanar with an outer face of the support wall;

two attachment flanges for attaching the device to the support wall, each of said attachment flanges extending from and coplanar with one of the wing portions, with a part of each of said attachment flanges having a linear longitudinal central axis which is not collinear with the linear longitudinal central axis of the wing portion from which said attachment flange extends; and means for fixedly attaching the attachment flanges to the underlying support wall.

13. The device of claim 12 wherein the two attachment flanges are positionable for attachment to the underlying support wall with one of the flanges positioned in stacked alignment between the second flange and the underlying support wall.

* * * * *